US011054094B2

(12) United States Patent
Yang et al.

(10) Patent No.: US 11,054,094 B2
(45) Date of Patent: Jul. 6, 2021

(54) SHOWCASE STRIP LAMP

(71) Applicants: Self Electronics Co., Ltd., Zhejiang (CN); Wanjiong Lin, Zhejiang (CN); Self Electronics USA Corporation, Norcross, GA (US)

(72) Inventors: Jun Yang, Zhejiang (CN); Kai Xu, Zhejiang (CN); Jianguo Dong, Zhejiang (CN); Binjie Xu, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/949,679

(22) Filed: Nov. 10, 2020

(65) Prior Publication Data

US 2021/0164626 A1 Jun. 3, 2021

(30) Foreign Application Priority Data

Nov. 30, 2019 (CN) ..... 201911209211.5

(51) Int. Cl.

| | |
|---|---|
| ***F21S 4/28*** | (2016.01) |
| ***F21K 9/69*** | (2016.01) |
| ***F21V 23/06*** | (2006.01) |
| ***F21V 29/503*** | (2015.01) |
| ***F21Y 115/10*** | (2016.01) |
| ***F21Y 103/10*** | (2016.01) |

(52) U.S. Cl.

CPC ..... *F21S 4/28* (2016.01); *F21K 9/69* (2016.08); *F21V 23/06* (2013.01); *F21V 29/503* (2015.01); *F21Y 2103/10* (2016.08); *F21Y 2115/10* (2016.08)

(58) Field of Classification Search

CPC ..... F21S 4/28; F21V 23/06; F21V 29/503; F21K 9/69; F21Y 2115/10; F21Y 2103/10

See application file for complete search history.

(56) References Cited

U.S. PATENT DOCUMENTS

| | | | | |
|---|---|---|---|---|
| 8,066,411 | B1 * | 11/2011 | Barton | F21K 9/272 362/310 |
| 8,967,825 | B2 * | 3/2015 | Fukui | F21V 23/006 362/218 |
| 9,016,895 | B2 * | 4/2015 | Handsaker | F21V 5/04 362/235 |

(Continued)

*Primary Examiner* — Joseph L Williams
*Assistant Examiner* — Jose M Diaz
(74) *Attorney, Agent, or Firm* — Wang Law Firm, Inc.

(57) ABSTRACT

A showcase strip lamp includes a lamp tube, having a tube wall provided with a plurality of first light emitting holes arranged at intervals in the length direction; a circuit board, disposed in the lamp tube and being with the front face facing the first light emitting hole; a plurality of light sources, corresponding to each first light emitting hole and arranged on the circuit board; a heat conducting member, being contact-connected between the back of the circuit board and the inner wall of the lamp tube; and an end cover assembly, disposed on ends of the lamp tube. The heat on the circuit board are quickly conducted to the lamp tube through the heat conducting member, and the lamp tube is only provided with a first light emitting hole for light output, and the lamp tube is used for heat dissipation as a whole.

23 Claims, 9 Drawing Sheets

(56) References Cited

U.S. PATENT DOCUMENTS

| | | | | |
|---|---|---|---|---|
| 2012/0162974 | A1* | 6/2012 | Yu | F21V 15/013 362/218 |
| 2013/0293098 | A1* | 11/2013 | Li | F21V 3/02 313/512 |
| 2015/0276138 | A1* | 10/2015 | Rowlette, Jr. | F21V 19/003 362/223 |
| 2017/0336064 | A1* | 11/2017 | Simon | E04F 11/1836 |
| 2018/0224103 | A1* | 8/2018 | Crandell | F21S 8/061 |
| 2019/0266929 | A1* | 8/2019 | Beille | G09F 13/22 |
| 2019/0277460 | A1* | 9/2019 | Van Winkle | F21S 4/20 |
| 2020/0041103 | A1* | 2/2020 | Germain | F21S 8/04 |
| 2020/0217461 | A1* | 7/2020 | Kuppens | F21K 9/68 |

* cited by examiner

SHOWCASE STRIP LAMP

RELATED APPLICATION

This application claims priority to a Chinese Patent Application No. CN 201911209211.5, filed on Nov. 30, 2019.

FIELD OF THE TECHNOLOGY

The present invention relates to the field of lighting technology, with particular emphasis on a showcase strip lamp.

BACKGROUND OF THE INVENTION

Showcases are used to display commodities or collections. They are often used in shopping malls, supermarkets, museums, exhibition halls and other places. They are usually made of high-transparent glass and assembled into a closed cabinet with beautiful appearance and full display of exhibits. Showcase lights are lamps installed inside or above the display cabinets. In order to provide a good lighting effect for the exhibits, they need to protrude the color, shape, glare and other characteristics of the exhibits, and also make the lamp body as invisible as possible without causing interference to the exhibits. Due to the need for fixing and heat dissipation, the size of the showcase light cannot be made small, so the invisible effect cannot be achieved.

BRIEF SUMMARY OF THE INVENTION

In view of this, the present invention provides a showcase strip lamp to solve the above technical problems.

A showcase strip lamp comprises:

lamp tube, being with tube wall provided with a plurality of first light emitting holes arranged at intervals in the length direction;

circuit board, disposed in the lamp tube and being with the front face facing the first light emitting hole;

a plurality of light sources, corresponding to each first light emitting hole and arranged on the circuit board;

heat conducting member, being contact-connected between the back of the circuit board and the inner wall of the lamp tube;

and end cover assembly, disposed on ends of the lamp tube.

advantageously, the lamp tube is made of metal material.

advantageously, the lamp tube is a round tube.

advantageously, the outer diameter of the cross section of the lamp tube is 7 mm~10 mm.

advantageously, the light source uses LED chips, and the power of a single chip is 0.5 W~1.5 W.

advantageously, the heat conducting member is a heat pipe.

advantageously, one side of the heat conducting member is a plane in contact with the back surface of the circuit board, and opposite side is a curved surface that fits with the inner wall of the lamp tube.

advantageously, an insulation baffle is provided between the front surface of the circuit board and the inner wall of the lamp tube, and the insulation baffle is provided with a second light emitting hole corresponding to the light source.

advantageously, the circuit board and the insulation baffle are fixedly connected.

advantageously, each light source is provided with an optical lens in its light emitting direction.

advantageously, each first light emitting hole is correspondingly provided with a light shield.

advantageously, the light shield is provided with a first fixed connecting member (601) that cooperates with the first light emitting hole.

advantageously, an insulation baffle is provided between the front surface of the circuit board and the inner wall of the lamp tube, and the insulation baffle is provided with a second fixed connecting member that cooperates with the light shield.

advantageously, the first light emitting hole is a square hole, including two first sides parallel to the length direction of the lamp tube and two second sides perpendicular to the length direction of the lamp tube.

advantageously, the light shield is provided with two first fixed connecting members which are respectively engaged with the first side.

advantageously, an insulation baffle is provided between the front surface of the circuit board and the inner wall of the lamp tube, and the insulation baffle is provided with a second fixed connecting member that cooperates with the light shield, and there are two second fixed connecting member corresponding to each light shield, and the two second fixed connecting member are distributed on both sides of the second light emitting hole along the length direction of the lamp tube.

advantageously, the end cover assembly uses a plug connector that is rotatable and electrically connected.

advantageously, the end cover assembly is a DC plug that encapsulates the end of the lamp tube.

advantageously, when the end cover assembly is a male plug that encapsulates the end of the lamp tube, the end cover assembly is disposed in the lamp tube and the lamp tube is provided with an extension section outward, and an inner wall of the extension section is provided with an elastic member which cooperates with an outer peripheral wall of a female plug for external power supply, and the elastic member provides positioning support for relative rotation of the plug connector.

advantageously, the end cover assembly is provided with two sets, which are respectively disposed at both ends of the lamp tube.

advantageously, two sets of end cover assemblies are male and female plug connectors, respectively.

advantageously, at least one power supply upright tube electrically connected to the end cover assembly is further provided, and the power supply upright tube is provided with a power supply plug connector that cooperates with the end cover assembly.

advantageously, a power supply plug connector is provided on the top of the power supply upright tube.

advantageously, the plugging direction of the power supply plug connector is perpendicular to the power supply upright tube.

Technical Effect of the Invention

The showcase strip lamp of the present invention quickly conducts the heat on the circuit board to the lamp tube through the heat conducting member, and the lamp tube is only provided with a first light emitting hole for light output, and the lamp tube is used for heat dissipation as a whole. The heat dissipation effect is good, and then the power of the light source can be set larger, so that the strip lamp can also realize the key lighting.

BRIEF DESCRIPTION OF THE DRAWINGS

The following describes embodiments of the present invention with reference to the accompanying drawings, in which.

DETAILED DESCRIPTION OF THE INVENTION

Figure 1:
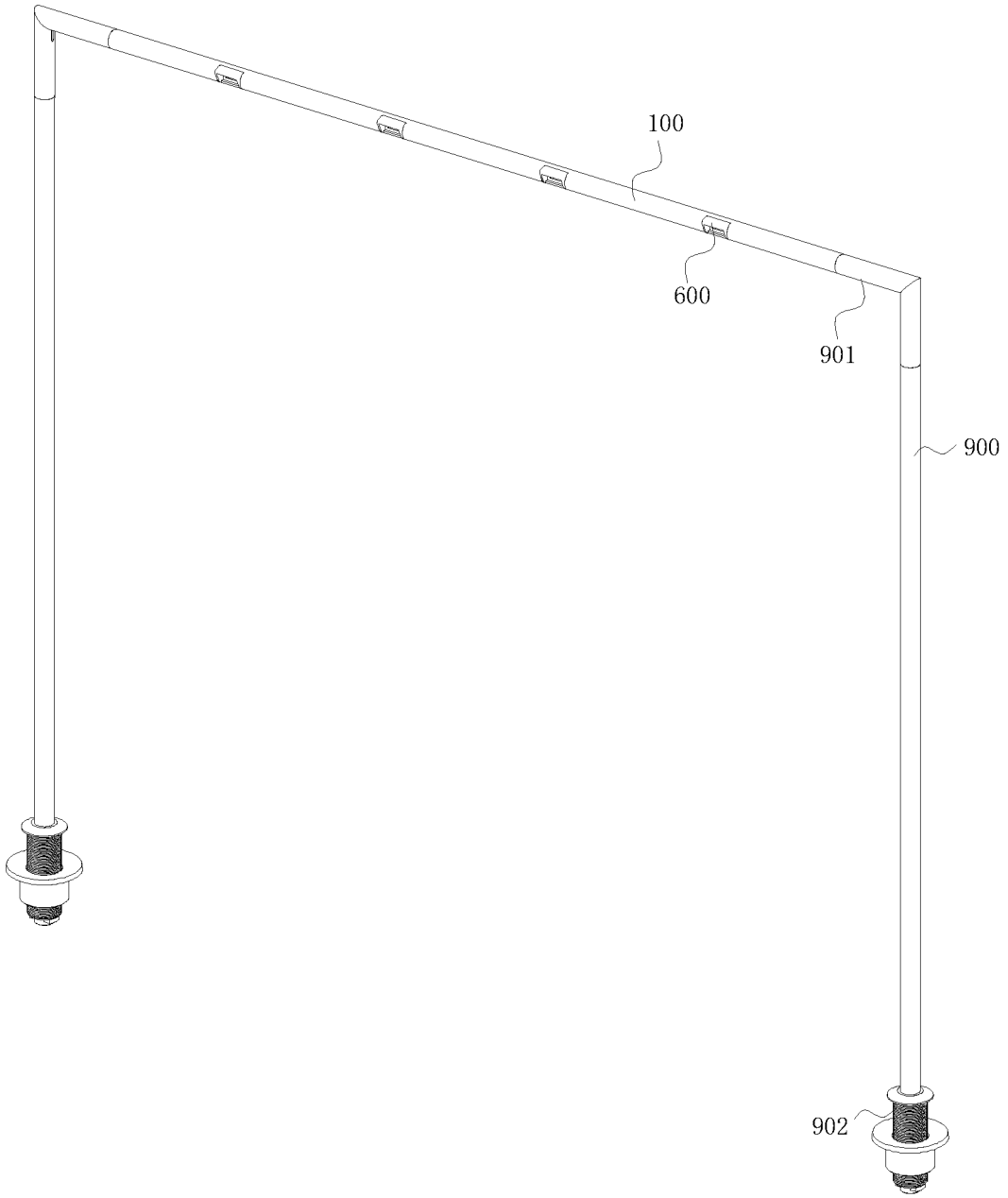
FIG. 1 is a three-dimensional structure diagram of a showcase strip lamp of this embodiment.
Figure 2:
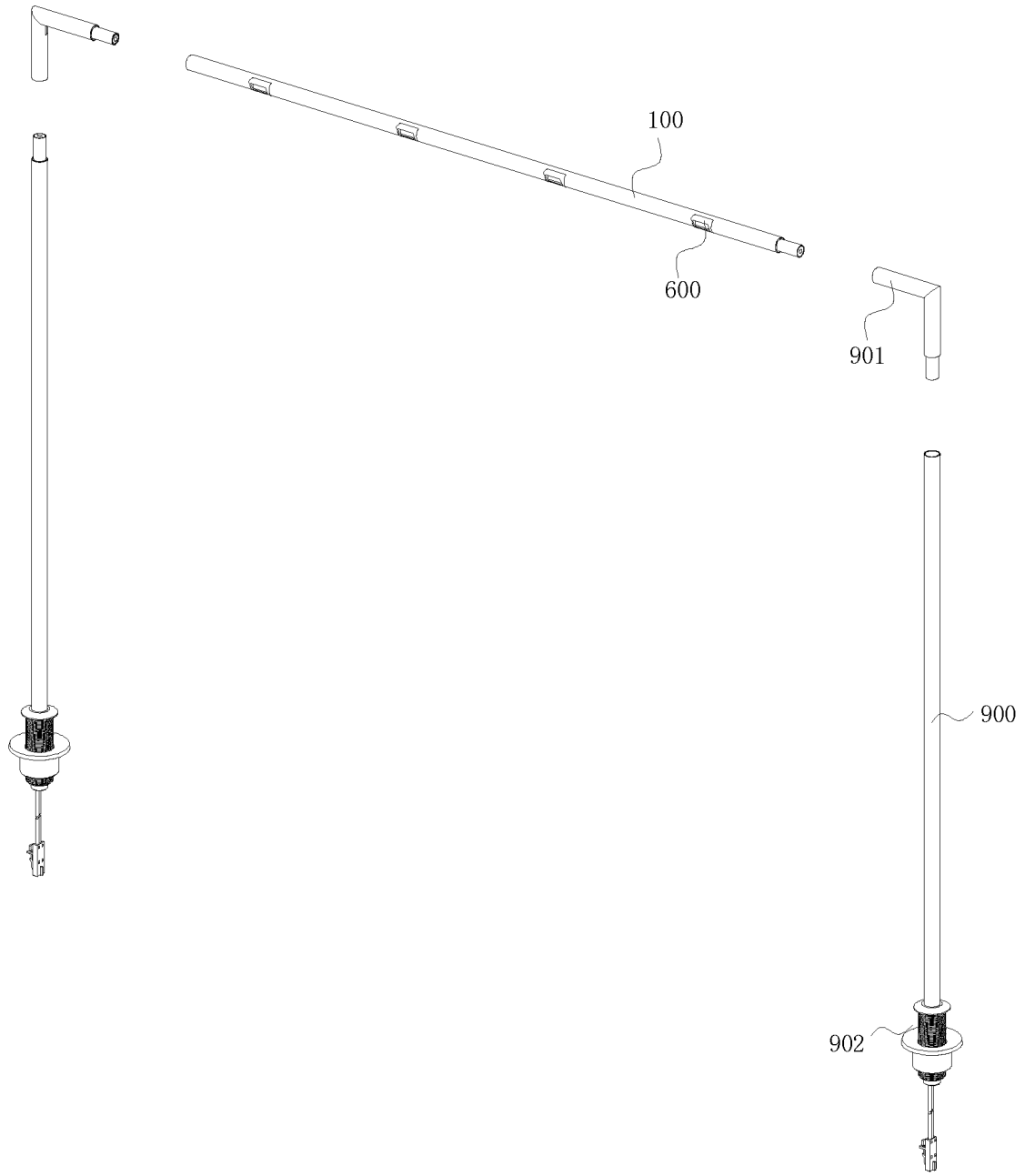
FIG. 2 is a schematic structural view of the showcase strip lamp of this embodiment after being split.
Figure 3:
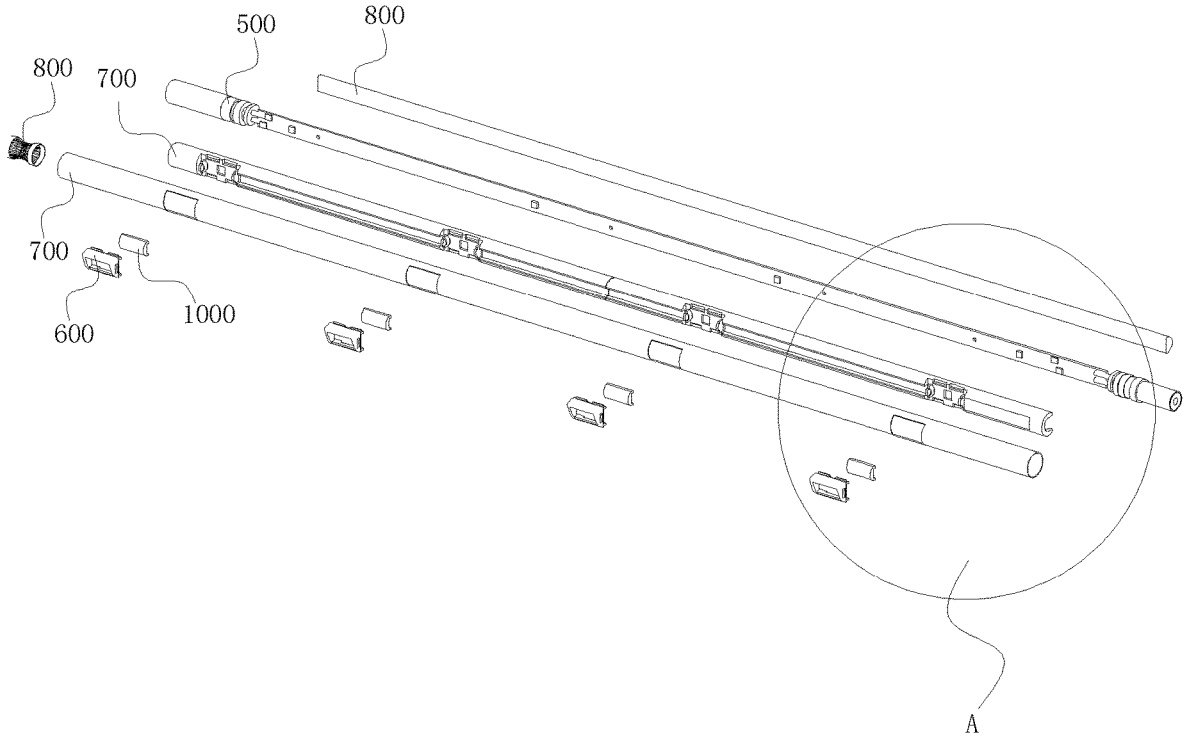
FIG. 3 is an exploded schematic diagram of the lamp tube and the internal structure thereof of the showcase strip lamp of the embodiment.
Figure 4:
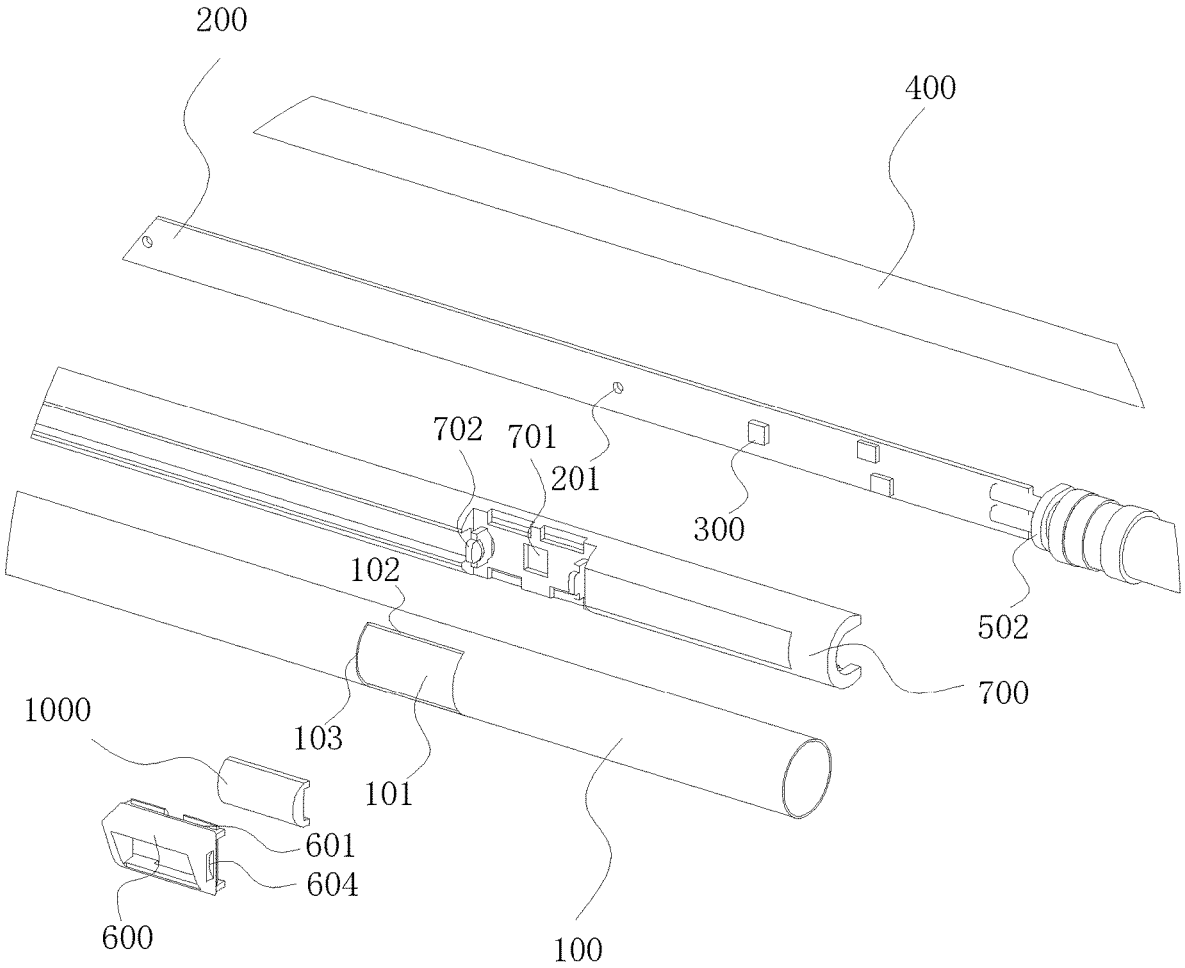
FIG. 4 is an enlarged schematic view of part A in FIG. 3.
Figure 5:
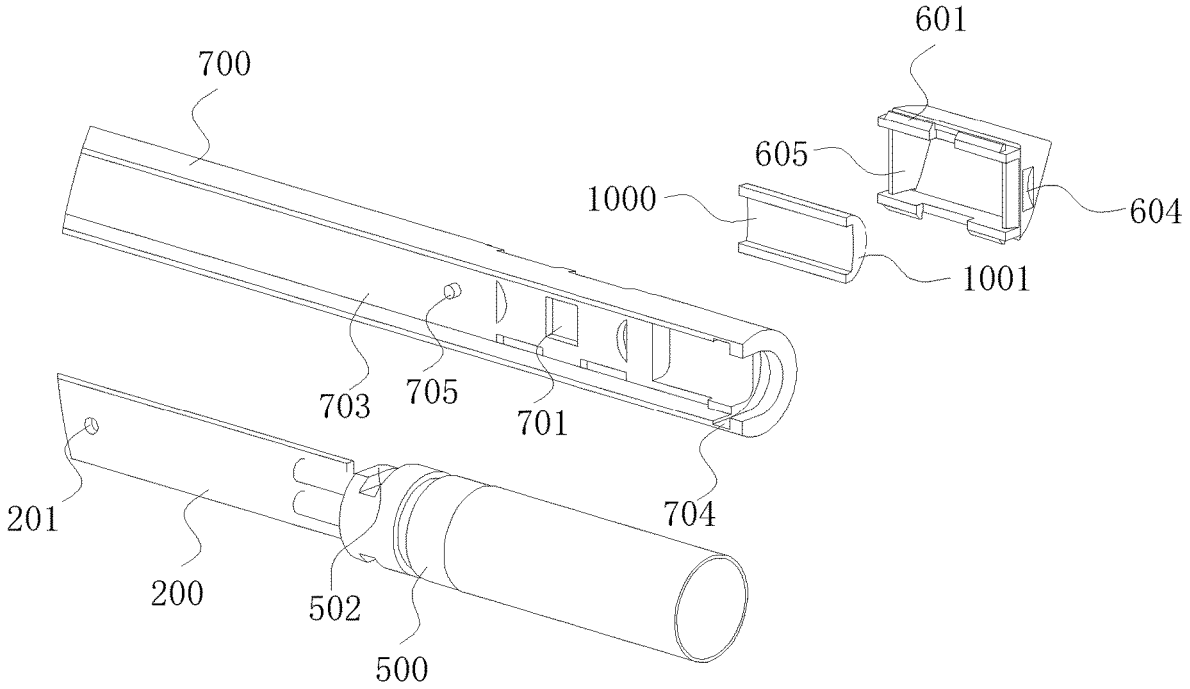
FIG. 5 is an exploded schematic view of some components in FIG. 4 from another perspective.
Figure 6:
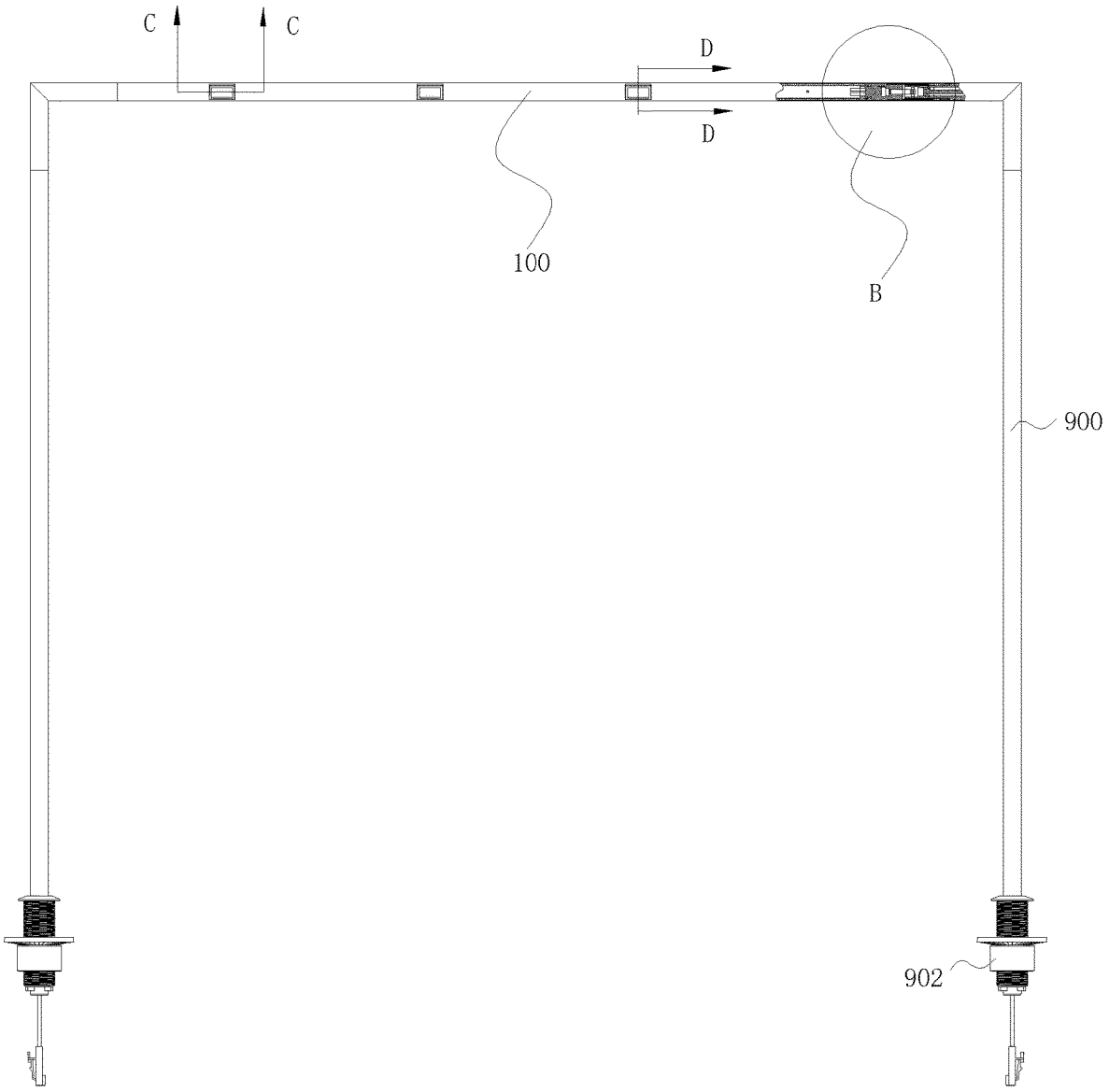
FIG. 6 is a three-dimensional structural schematic diagram of the showcase strip lamp of this embodiment.
Figure 7:
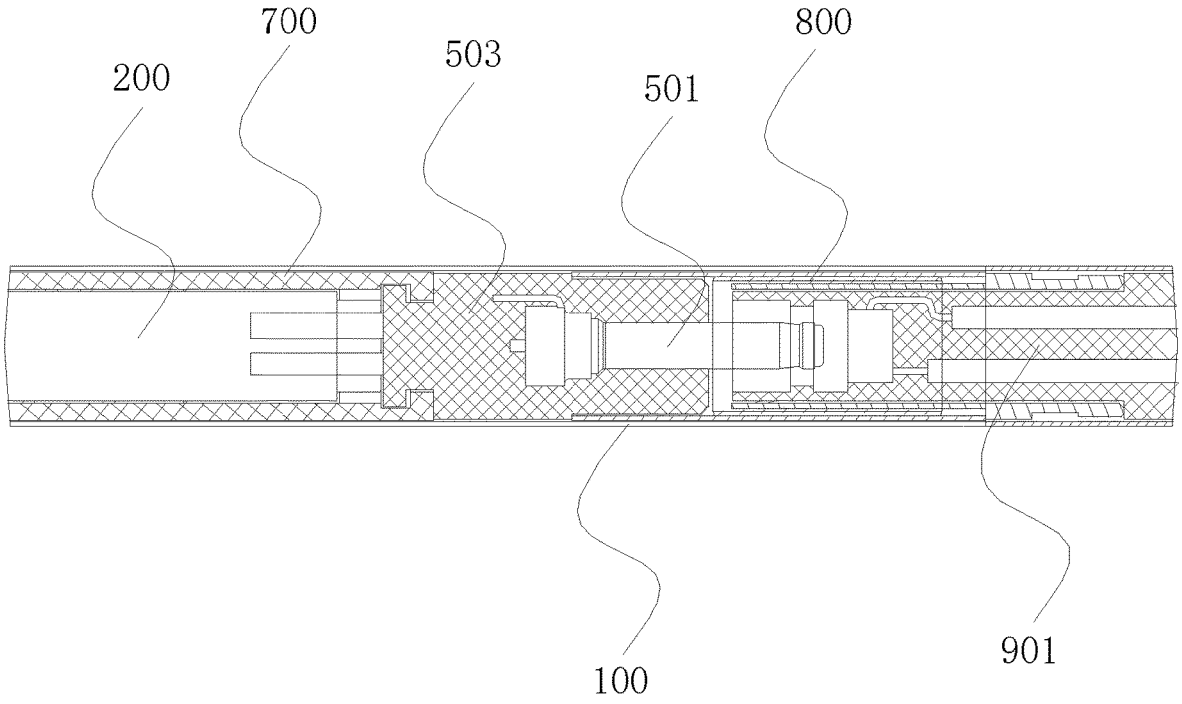
FIG. 7 is an enlarged schematic view of part B in FIG. 6.
Figure 8:
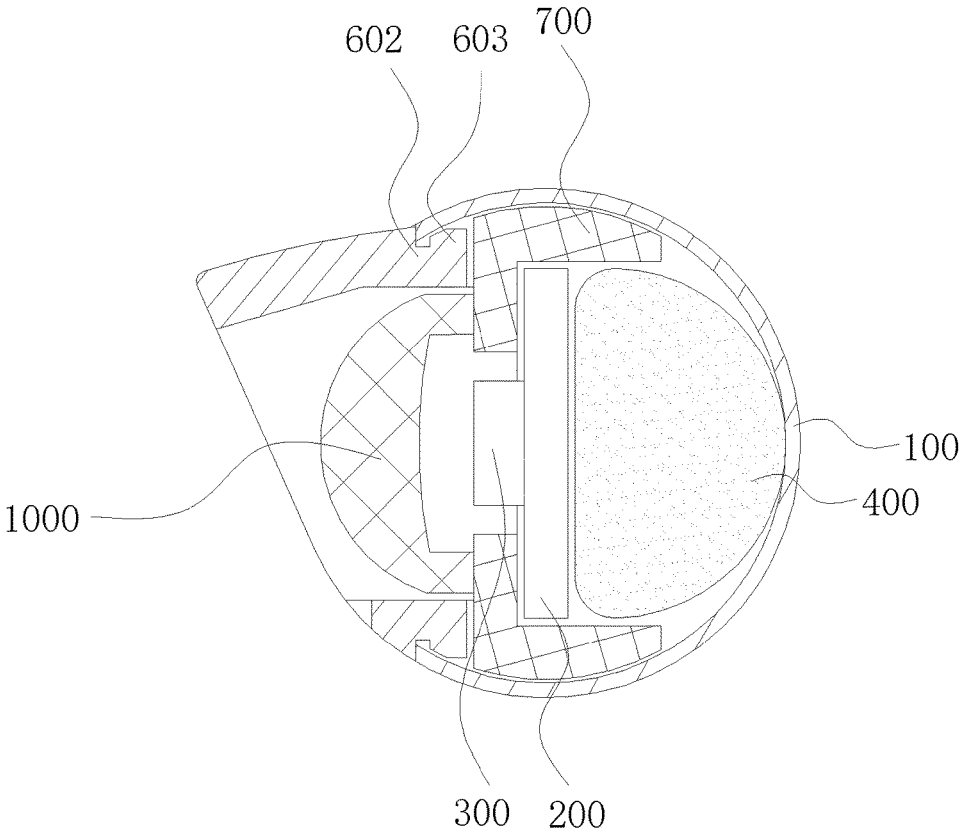
FIG. 8 is a schematic cross-sectional view of FIG. 6 in the direction C-C.
Figure 9:
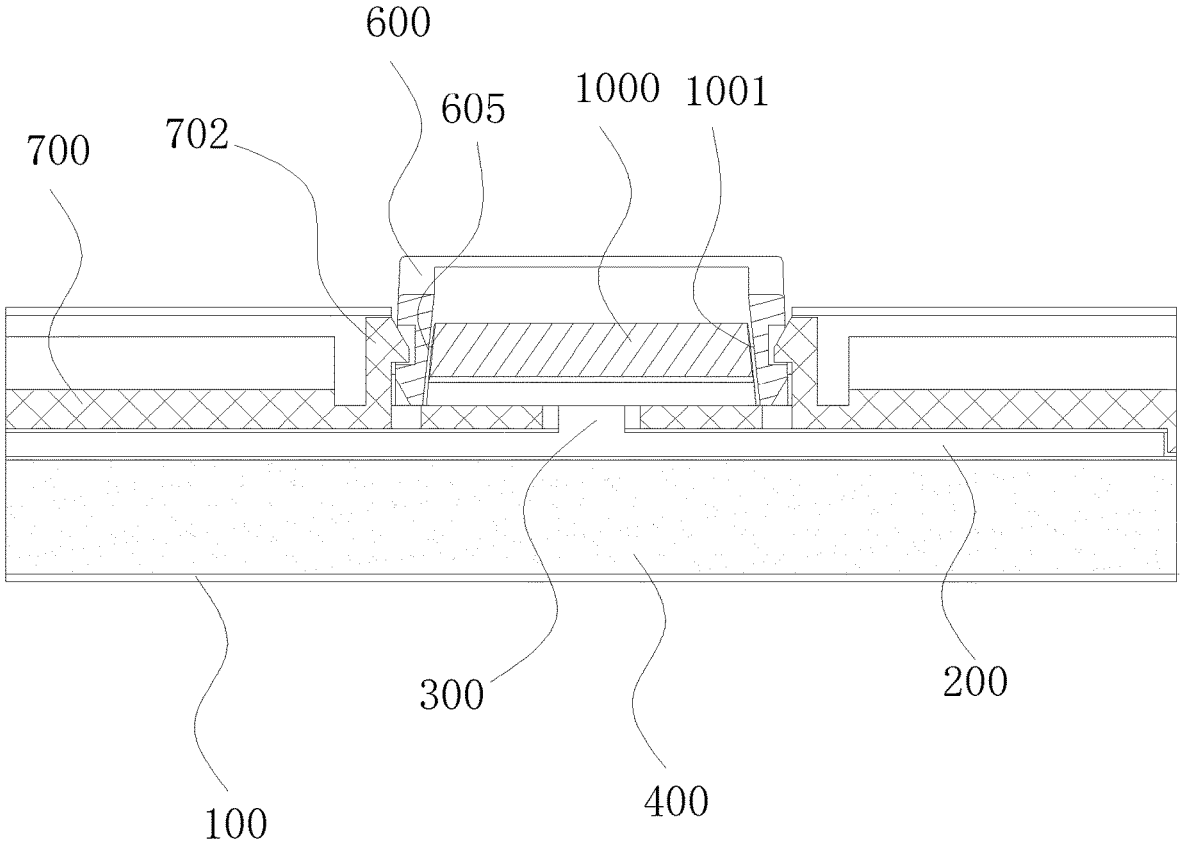
FIG. 9 is a schematic cross-sectional view of FIG. 6 in the direction D-D.
Figure 10:
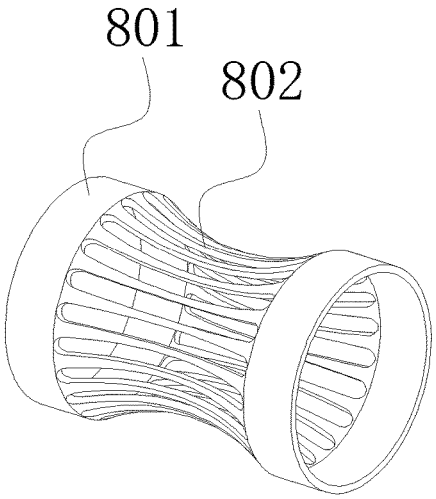
FIG. 10 is a three-dimensional structural diagram of the elastic member of this embodiment.

Hereinafter, specific embodiments of the present invention will be described in further detail based on the drawings. It should be understood that the description of the embodiments of the present invention is not intended to limit the protection scope of the present invention.

As shown in FIGS. 1-10, the showcase strip lamp of this embodiment includes a lamp tube 100, a circuit board 200, a plurality of light sources 300, a heat conducting member 400, and an end cover assembly 500.

the lamp tube 100 and the end cover assembly 500 are generally used to carry other components and used for fixing and installing the lamp body. The end cover assembly 500 is also used for connecting external power supply device in a form that can be set according to assembly requirements. In this embodiment, a plurality of first light emitting holes 101 arranged at intervals in the length direction are arranged on tube wall of the lamp tube 100; the circuit board 200 is provided in the lamp tube 100, and the front face faces the first light emitting hole 101; A plurality of light sources 300 corresponding to each first light emitting hole 101 are arranged on the circuit board; the heat conducting member 400 is contact-connected between the back of the circuit board 200 and the inner wall of the lamp tube 100; the end cover assembly 500 is provided on ends of the lamp tube.

The above structure quickly conducts the heat on the circuit board 300 to the lamp tube 100 through the heat conducting member 400, and the lamp tube 100 is only provided with a first light emitting hole 101 for emitting light, and the lamp tube is used for heat dissipation as a whole. The heat dissipation effect is good, and then the power of the light source can be set larger, so that the strip lamp can also realize the key lighting.

In order to improve the heat dissipation effect, the lamp tube 100 in this embodiment adopts a metal material, and it is further preferred that the metal material is metal copper. To balance strength, it is further preferred that the metal material is H62 brass. Therefore, the tube wall can be made very thin, and the space in the lamp tube 100 is relatively larger.

The cross-sectional shape of the lamp tube 100 is a circle, a square, or other shapes. In this embodiment, the lamp tube 100 is a round tube, so that both small volume and large heat dissipation area are considered.

In this embodiment, the outer diameter of the cross section of the lamp tube 100 is 7 mm~10 mm; the light source 300 uses LED chips, and the power of a single chip is 0.5 W~1.5 W. In this embodiment, LED chips with medium and high power are used to realize single key illumination of the strip lamp with a smaller size.

The heat conducting member 400 uses a metal material. In order to improve the heat conducting effect, the heat conducting member 400 is a heat pipe. The heat pipe can quickly extract heat and improve the heat dissipation effect. Further preferably, one side of the heat conducting member 400 is a plane in contact with the back surface of the circuit board 200, and the opposite side is a curved surface that fits with the inner wall of the lamp tube 100.

In order to improve the safety factor of the lamp, in this embodiment, an insulation baffle 700 is provided between the front surface of the circuit board 200 and the inner wall of the lamp tube 100, and the insulation baffle 700 is provided with a second light emitting hole 701 corresponding to the light source 300. The insulation baffle 700 can be made of plastics and other insulating materials with good plasticity. In order to further reduce the size, the LED chip is embedded in the second light emitting hole 701. To further reduce the size, in this embodiment, the circuit board and the insulation baffle are fixed connection. There are many ways of fixed connection. In this embodiment, the insulation baffle 700 is provided with a protrusion 702 on the side facing the circuit board 200, and the circuit board 200 is provided with a fixing hole 201 that cooperates with the protrusion 702. During fixation, the protrusion 702 passes through the fixing hole 201 and then is ironed on the back to complete the fixed connection.

To facilitate positioning, on the side of the insulation baffle 700 facing the circuit board 200 is provided with a mounting groove 703 for accommodating the circuit board 200, and the heat conducting member 400 is also partially located in the mounting groove 703.

Of course, the insulation baffle 700 can also be in the form of a film. When the insulating film is transparent, it can be directly covered over the light source, and no hole is needed.

In order to better implement the key lighting, in this embodiment, each light source 300 is provided with an optical lens 1000 in its light emitting direction. The optical lens 1000 can be directly fixed on the circuit board 200 or the insulation baffle 700. The optical lens 1000 is a condenser lens.

In order to prevent glare, each first light emitting hole 101 is correspondingly provided with a light shield 600. In order to facilitate the installation of the light shield 600, the light shield 600 is provided with a first fixed connecting member 601 which cooperates with the first light emitting hole 101. Of course, the light shield 600 can also be connected to the insulation baffle 700 to be fixed, and the insulation baffle 700 is provided with a second fixed connecting member 702 that cooperates with the light shield 600. In order to make the fixing of the light shield 600 more reliable, at the same time, the insulation baffle 700 and the lamp tube 100 can be fixedly connected through the light shield 600. To simplify the assembly, in this embodiment, a first fixed connecting member 601 and second fixed connecting member 702 that cooperate with the light shield 600 are provided at the same time.

In this embodiment, in order to facilitate assembly, the optical lens 1000 is fixed in the light shield 600, and the inner side of the light shield 600 is provided with a inclined surface 605, and both sides of the optical lens 1000 are provided with a fixed surface 1001 that cooperates with the inclined surface 605, after the light shield 600 is fixed, the optical lens 1000 is pressed and fixed.

In order to make the connection stronger, in this embodiment, the first light emitting hole 101 is a square hole, but it can also be of other shapes. The first light emitting hole 101 includes two first sides 102 parallel to the longitudinal direction of the lamp tube 100 and two second sides 103 perpendicular to the longitudinal direction of the lamp tube 100.

The light shield 600 is provided with two first fixed connecting members 601 which are respectively engaged with the first side 102. There are two second fixed connecting member 702 corresponding to each light shield 600, and the two second fixed connecting member 702 are distributed on both sides of the second light emitting hole 701 along the length direction of the lamp tube 100.

Specifically, the first fixed connecting member 601 includes a clamping edge 602 extending into the first light emitting hole 101 and a hook portion 603 provided at the free end of the clamping edge 602. Two sides of the light shield 600 are provided with card slots 604, and the second fixed connecting member 702 is a buckle matched with the card slot.

The end cover assembly 500 is used to encapsulate the end of the lamp tube 100 and to set plug connector. In this embodiment, the end cover assembly 500 uses a plug connector that is rotatably and electrically connected. Specifically, the end cover assembly 500 is a DC plug that encapsulates the end of the lamp tube 100.

In order to facilitate installation, in this embodiment, the base 503 of the end cover assembly 500 is fixedly connected to the insulation baffle 700, and the end of the insulation baffle 700 is provided with a fixing groove 704 with a radial opening. One end of the end cover assembly 500 connected to the circuit board is provided with a radial raised snap ring 502 matched with the fixing groove 704. The bottom arc fitting of the fixed groove 704 and the snap ring 502 and the two sides' planes are fitted to achieve axial and circumferential fixation.

The showcase strip lamps of this embodiment can be plug-in power supply at one end or plug-in power supply at both ends. In this embodiment, the end cover assembly 500 is provided with two sets, which are respectively disposed at both ends of the lamp tube 100.

In order to facilitate the interconnection of multiple showcase strip lamps, the two sets of end cover assemblies 500 are male and female plug connectors, respectively. Therefore, the showcase strip lamps of this embodiment can be interconnected.

In order to make the lamp body of this embodiment rotate more smoothly and facilitate positioning, when the end cover assembly 500 is a male plug 501 that encapsulates the end of the lamp tube 100, the end cover assembly 500 is disposed in the lamp tube 100 and the lamp tube 100 is provided with an extension section 104 outward, and an inner wall of the extension section 104 is provided with an elastic member 800 which cooperates with an outer peripheral wall of a female plug for external power supply (that is, the power supply plug connector 901 in this embodiment). The elastic member 800 provides positioning support for the relative rotation of the plug connector.

The structure of the elastic member 800 can use an elastic washer or a drum spring. The elastic member 800 of this embodiment includes mounting rings 801 provided on both sides and an elastic piece 802 connecting the two mounting rings 801. The middle part of the elastic piece 802 is concave inward, so that when the female plug and the male plug cooperate, the outer peripheral wall of the female plug is pressed against the elastic piece 802, positioning is realized through friction, and stable rotation is ensured at the same time.

In order to facilitate fixing and installation, in this embodiment, at least one power supply upright tube 900 electrically connected to the end cover assembly 500 is further provided, and the power supply upright tube 900 is provided with a power supply plug connector 901 that cooperates with the end cover assembly 500. In this embodiment, the power supply plug connector 901 is a female plug connecting externally power supply. When the end cover assembly 500 is a female plug, the power supply plug connector 901 is provided with an inner cavity for accommodating the female plug and an elastic member provided in the inner cavity.

The power supply upright tube 900 is generally provided with a wire for power supply, and a mounting seat 902 fixed to the showcase is provided at the bottom. The mounting seat 902 can adopt the structure in the prior art, which is not the focus of the present invention and will not be repeated here.

In this embodiment, two power supply upright tubes 900 are provided, which are arranged on both sides of the lamp tube 100, and cooperate with a plug connector, respectively, to achieve the overall effect of the goal light.

In this embodiment, a power supply plug connector 901 is provided on the top of the power supply upright tube 900. The power supply plug connector 901 is a detachable elbow, and the plugging direction of the power supply plug connector 901 is perpendicular to the power supply upright tube 900.

Figure 11:
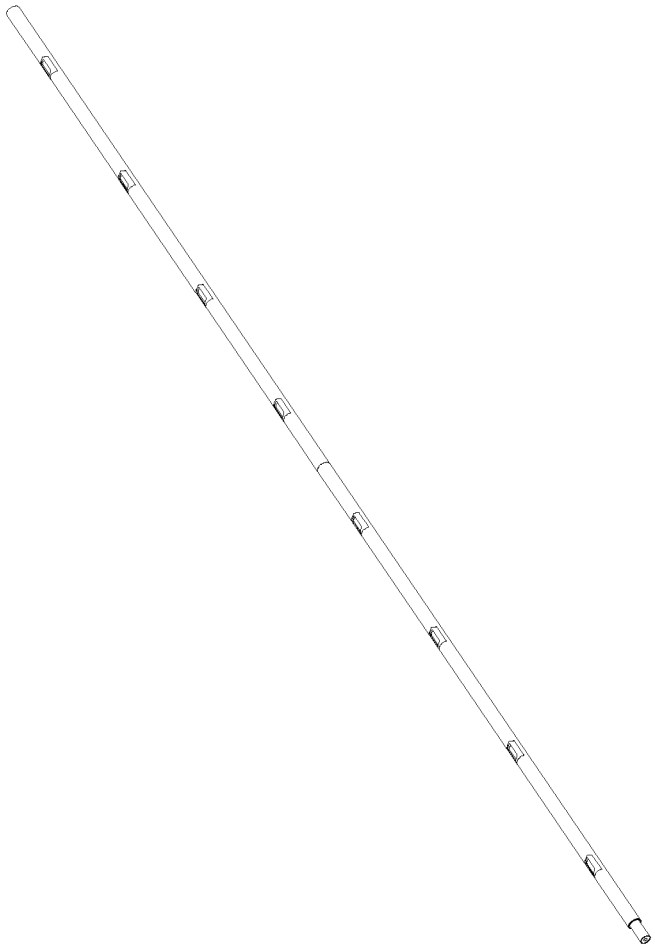
FIG. 11 is a schematic structural diagram of another implementation manner of the showcase strip lamp of this embodiment.

In addition, the power supply upright tube 900 is not necessary, and the structure supporting the lamp body can be externally installed, such as a snap structure and the like. Multiple lamps 100 can also be interconnected through the interconnection of the end cover assembly 500, as shown in FIG. 11.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A showcase strip lamp comprises:

a lamp tube (100), having a tube wall provided with a plurality of first light emitting holes (101) arranged at intervals in a lengthwise direction;

a circuit board (200), disposed in the lamp tube (100) and having a front face facing the plurality of first light emitting holes (101);

a plurality of light sources (300) arranged on the circuit board (200), each light source corresponding to a first light emitting hole of the plurality of first light emitting holes (101);

a heat conducting member (400), in contact between a back of the circuit board (200) and an inner wall of the lamp tube (100);

an end cover assembly (500), disposed on ends of the lamp tube; and an insulation baffle (700) disposed between the front face of the circuit board (200) and the inner wall of the lamp tube (100), and the insulation baffle (700) is provided with a second light emitting hole (701) corresponding to a light source of the plurality of light sources (300).

2. The showcase strip lamp as claimed in claim 1, wherein the lamp tube (100) is made of metal material.

3. The showcase strip lamp as claimed in claim 1, wherein the lamp tube (100) is a round tube.

4. The showcase strip lamp as claimed in claim 3, wherein the outer diameter of the cross section of the lamp tube (100) is 7 mm~10 mm.

5. The showcase strip lamp as claimed in claim 1, wherein the plurality of light sources (300) uses LED chips, and the power of a single chip is 0.5 W~1.5 W.

6. The showcase strip lamp as claimed in claim 1, wherein the heat conducting member (400) is a heat pipe.

7. The showcase strip lamp as claimed in claim 1, wherein one side of the heat conducting member (400) is a plane in contact with the back surface of the circuit board (200), and opposite side is a curved surface that fits with the inner wall of the lamp tube (100).

8. The showcase strip lamp as claimed in claim 1, wherein the circuit board (200) and the insulation baffle (700) are fixedly connected.

9. The showcase strip lamp as claimed in claim 1, wherein each light source (300) is provided with an optical lens (1000) in its light emitting direction.

10. The showcase strip lamp as claimed in claim 1, wherein each first light emitting hole (101) is correspondingly provided with a light shield (600).

11. The showcase strip lamp as claimed in claim 10, wherein the light shield (600) is provided with a first fixed connecting member (601) that cooperates with the first light emitting hole (101).

12. The showcase strip lamp as claimed in claim 10, wherein the insulation baffle (700) is provided with a second fixed connecting member (702) that cooperates with the light shield (600).

13. The showcase strip lamp as claimed in claim 10, wherein the first light emitting hole (101) is a square hole, including two first sides parallel to the lengthwise direction of the lamp tube (100) and two second sides (103) perpendicular to the lengthwise direction of the lamp tube (100).

14. The showcase strip lamp as claimed in claim 13, wherein the light shield (600) is provided with two first fixed connecting members (601) which are respectively engaged with the first side (102).

15. The showcase strip lamp as claimed in claim 14, wherein the insulation baffle (700) is provided with a second fixed connecting member (702) that cooperates with the light shield (600), and there are two second fixed connecting members (702) corresponding to each light shield (600), and the two second fixed connecting members (702) are distributed on both sides of the second light emitting hole (701) along the lengthwise direction of the lamp tube (100).

16. The showcase strip lamp as claimed in claim 1, wherein the end cover assembly (500) uses a plug connector that is rotatable and electrically connected.

17. The showcase strip lamp as claimed in claim 16, wherein the end cover assembly (500) is a DC plug that encapsulates the end of the lamp tube (100).

18. The showcase strip lamp as claimed in claim 16, wherein when the end cover assembly (500) is a male plug (501) that encapsulates the end of the lamp tube (100), the end cover assembly (500) is disposed in the lamp tube (100) and the lamp tube (100) is provided with an extension section (104) outward, and an inner wall of the extension section (104) is provided with an elastic member (800) which cooperates with an outer peripheral wall of a female plug for external power supply, and the elastic member (800) provides positioning support for relative rotation of the plug connector.

19. The showcase strip lamp as claimed in claim 1, wherein the end cover assembly (500) is provided with two sets of plug connectors, which are respectively disposed at both ends of the lamp tube (100).

20. The showcase strip lamp as claimed in claim 19, wherein two sets of end cover assemblies (500) are male and female plug connectors, respectively.

21. The showcase strip lamp as claimed in claim 1, wherein at least one power supply upright tube (900) electrically connected to the end cover assembly (500) is further provided, and the power supply upright tube (900) is provided with a power supply plug connector (901) that cooperates with the end cover assembly (500).

22. The showcase strip lamp as claimed in claim 21, wherein a power supply plug connector (901) is provided on the top of the power supply upright tube (900).

23. The showcase strip lamp as claimed in claim 22, wherein the plugging direction of the power supply plug connector (901) is perpendicular to the power supply upright tube (900).

* * * * *